US005220538A

United States Patent [19]

Flanagan et al.

[11] Patent Number: 5,220,538

[45] Date of Patent: Jun. 15, 1993

[54] ELECTRO-ACOUSTIC TRANSDUCER INSULATION STRUCTURE

[75] Inventors: Peter F. Flanagan, Cranston; Ascanio G. DiPippo, Middletown, both of R.I.; Richard R. Langhoff, Mattapoisett, Mass.; George V. Morris, East Providence, R.I.

[73] Assignee: Raytheon Company, Lexington, Mass.

[21] Appl. No.: 749,651

[22] Filed: Aug. 8, 1991

[51] Int. Cl.[5] ..... H04R 17/00

[52] U.S. Cl. ..... 367/157; 367/159; 367/176; 310/334; 310/337

[58] Field of Search ..... 367/157, 159, 912, 152, 367/176; 310/334, 337, 369; 381/190; 29/254, 25.35

[56] References Cited

U.S. PATENT DOCUMENTS

| | | | |
|---|---|---|---|
| 4,651,044 | 3/1987 | Kompanek | 310/323 |
| 4,672,591 | 6/1987 | Breimesser et al. | 367/152 |
| 4,698,541 | 10/1987 | Bar-Cohen | 310/326 |
| 5,020,035 | 5/1991 | Kompanek | 367/159 |

*Primary Examiner*—J. Woodrow Eldred

*Attorney, Agent, or Firm*—Donald F. Mofford; Richard M. Sharkansky

[57] ABSTRACT

A bonded insulator flexural transducer for use in sonar applications includes a hollow metal tube having an inner surface, a segmented ceramic electromechanical driver disposed along an inner surface of the tube and a bonded insulator disposed between the segmented driver and the metal tube. The bonded insulator includes a high dielectric strength film, a layer of a binding fiber material, and a layer of epoxy. The dielectric film provides the electrical isolation between the driver and the shell and the binding fiber material provides a reliable bond by effectively trapping the epoxy between the driver and shell.

14 Claims, 1 Drawing Sheet

ELECTRO-ACOUSTIC TRANSDUCER INSULATION STRUCTURE

BACKGROUND OF THE INVENTION

This invention relates generally to electro-acoustic transducers and more particularly to cylindrical transducers having insulation structures.

As is known in the art, a transducer is a device that converts energy from one form to another. In underwater acoustic systems, transducers generally are used to provide an electrical output signal in response to an acoustic input which propagates through a body of water or an acoustic output into the body of water in response to an input electrical signal.

An underwater acoustic transducer designed primarily for producing an electrical output in response to an acoustic input is called a hydrophone. Hydrophones are typically designed to operate over broad frequency ranges and are also generally small in size relative to the wavelength of the highest intended operating frequency.

A transducer intended primarily for the generation of an acoustic output signal in response to an electrical input is generally referred to as a projector. Projector dimensions are typically of the same order of magnitude as the operating wavelength of the projector. Moreover, projectors are generally narrowband devices, particularly compared to hydrophones. Both hydrophone and projector transducers are widely employed in sonar systems used for submarine and surface-ship applications.

Projectors generally include a mechanically driven member such as a piston, tube, or cylinder and a driver. The driver is responsive to electrical energy and converts such energy into mechanical energy to drive the mechanically driven member. The driven member converts the mechanical energy into acoustic waves which propagate in the body of water. Most acoustic transducers have driver elements which use materials having either magnetostrictive or piezoelectric properties. Magnetostrictive materials change dimension in the presence of an applied magnetic field, whereas piezoelectric materials undergo mechanical deformation in the presence of an electrical field. Because ceramic materials used in piezoelectric ceramic drivers are generally incapable of supporting tensile stresses, which often leads to fracturing of the ceramic, it is generally required that the ceramic driver be placed in a condition of precompression or prestress. Precompression protects the ceramic element from tensile forces which are generally detrimental to ceramic piezoelectrics.

Because acoustic transducers are used in a wide variety of applications, their size, shape and mode of operation can be quite different.

A configuration for acoustic transducers used when light weight and small size is needed is the split-ring cylindrical transducer. The split-ring transducer generally includes a continuous hollow tube having a longitudinal gap extending the length of the tube. The transducer also includes a cylindrical ceramic driver having a longitudinal gap at an angular displacement, such that when the driver is disposed within the tube, the respective gaps are generally aligned. In one configuration, a cylindrical ceramic driver has electrodes on the inner and outer surfaces and is polarized in a manner such that when an alternating current is applied across the electrodes, the driver causes the hollow tube to expand and contract in the radial direction. Accordingly, the ceramic driver and the hoop-mode projector are said to operate in the radial mode. The "C" shaped projector vibrates similarly to a tuning fork with the motion of the centers of vibration on either side of the diametral plane of the split having a large displacement normal to the plane as compared to the point diametrically opposite the split, which has a relatively small displacement.

Prestress is applied to the cylindrical ceramic driver by using a split hollow tube having a diameter somewhat smaller than the diameter of the ceramic cylinder driver. The opposing arms or tines of the tube are spread apart sufficiently for inserting the cylindrical ceramic element within the tube. Releasing the spreading forces on the opposing arms allows the tube to wrap itself around the ceramic driver and places the driver in compression. The resonant frequency of the split-ring projector is a function of the diameter as well as the thickness and elasticity modulus of the tube and ceramic driver materials.

There are several different types of piezoelectric ceramic drivers commonly used for split cylinder transducers.

The simplest and most common configuration uses the aforementioned cylindrical ceramic driver having electrodes on inner and outer surfaces of the cylinder. In applications where the cylindrical ceramic driver is unable to provide sufficient drive for a higher acoustic power split cylinder transducer, a barrel stave cylindrical driver may be used. Barrel stave driven transducers are known to provide as much as a 6 dB improvement in output acoustic power. The barrel stave driver includes a plurality of segmented sections of ceramic having electrodes disposed between individual ceramic segments. The polarity of the ceramic segments are alternated at every other electrode such that when driven with an alternating current, the driver causes the split cylinder tube to expand and contract circumferentially. The barrel stave cylindrical driver is said to operate in the circumferential mode.

A cylindrical ceramic driver which operates similarly to the barrel stave driver is the tangentially-poled ceramic driver. The tangentially-poled driver includes a cylindrical ceramic tube having a plurality of electrically conductive stripes disposed at predetermined and generally equally spaced locations around the circumference of the driver, with each conductor stripe forming a circuitous closed path around the wall of the driver. The electrically conductive stripes are generally painted on with a conductive paint, such as silver paint, and they are typically cured by a furnace firing process. In this configuration, the tangentially-poled ceramic driver appears and operates similarly to the barrel-stave ceramic driver.

One problem with both the barrel stave and tangentially-poled cylindrical drivers is that when placed in a metal shell, electrical continuity is provided between the ceramic driver and the shell, resulting in a short-circuited and inoperative transducer.

Further, the relatively high voltages generally needed for driving the ceramic elements require that any insulative layer provided between the shell and ceramic elements, must have a sufficiently high dielectric constant for preventing voltage breakdown and arcing through the layers and concurrently, that the insulative layer be sufficiently thin for providing as much of the energy generated by the ceramic to the shell rather than the energy being dissipated within the insulative layer.

One solution to this problem would be to use a shell fabricated from a non-conductive material. However, non-conductive shells having similar dimensions for use in a split-ring cylindrical transducer typically are fabricated from materials having a value of elasticity modulus that is generally inappropriate for use in certain applications, such as in a sonobuoy sonar systems. Further, the manufacturing costs of non-conductive shells is generally higher than for metal shells.

SUMMARY OF THE INVENTION

In accordance with the present invention, a transducer includes a transducer shell having an inner surface and an electromechanical driver disposed adjacent to the inner surface of the metal layer. The transducer further includes a pair of layers disposed over the inner surface of the shell, each comprised of an adhesive material having a first and second dielectric strength characteristic, respectively, and each layer having a layer of binding fibers disposed through the adhesive material. The transducer further includes an insulative layer disposed between the first and second layers, the insulative layer having a third dielectric strength characteristic greater than the first and second dielectric strength characteristics. With such an arrangement, an insulative layer disposed between a transducer shell and an electromechanical driver of a transducer provides electrical isolation between an electrically conductive portion of the transducer and the electromechanical driver. The fiber binding layer retains the adhesive layer between the metal layer and driver and further improves uniformity of the adhesive layer.

In accordance with a further aspect of the invention, a transducer includes a hollow metal tube having an inner surface and an electromechanical driver disposed adjacent to the inner surface of the metal tube. The transducer further includes a pair of layers disposed over the inner surface of the metal tube, each comprised of an epoxy having a first and second dielectric strength characteristic, respectively, each layer having a fiberglass layer disposed through the epoxy. The transducer further includes a polyimide film, disposed between the pair of layers, having a third dielectric strength characteristic greater than the first and second dielectric strength characteristics. With such an arrangement, a polyimide film disposed between a hollow metal tube and an electromechanical driver of a cylindrical transducer provides electrical isolation between the tube and driver and concurrently provides transmittance of energy from the driver to the tube.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENT

Figure 2A:
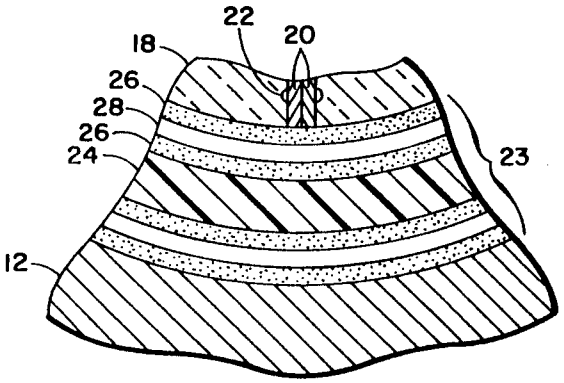
FIG. 2A is a blow-up cross sectional view of a portion of a split-ring cylindrical transducer taken along lines 2A—2A of FIG. 2.
Figure 2:
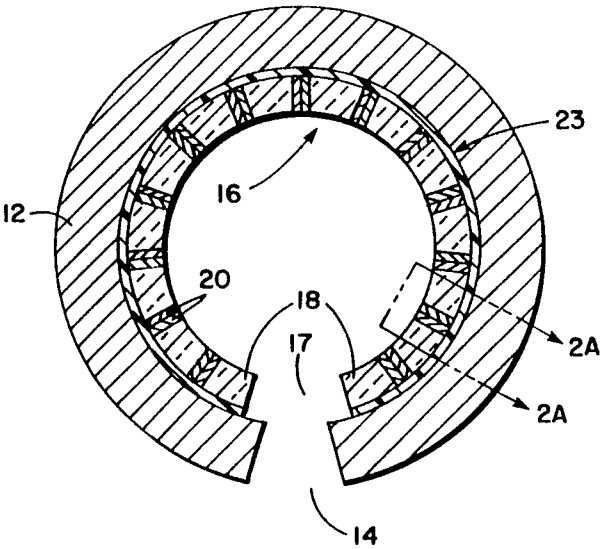
FIG. 2 is a cross sectional view of a portion of a split-ring cylindrical transducer taken along lines 2—2 of FIG. 1.
Figure 1:
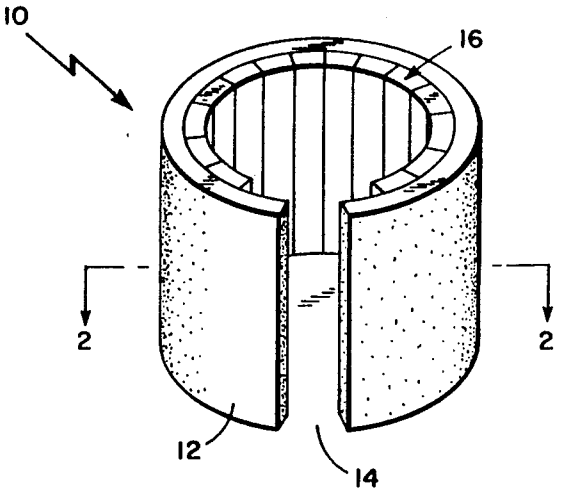
FIG. 1 is an exploded, somewhat diagrammatical, isometric view of a split-ring cylindrical transducer having a barrel staved cylindrical drive.

Referring now to FIGS. 1, 2, and 2A, a split-ring transducer assembly 10 is shown to include a hollow tube 12, fabricated from, here aluminum and having a longitudinal gap 14 along the length of the tube 12. The split-ring transducer assembly 10 further includes a cylindrical electromechanical driver assembly 16 bonded to an inner surface of the hollow tube 12. The driver assembly 16 has a driver slot 17 at essentially the same angular location of the longitudinal gap 14 of the tube 12.

The cylindrical electromechanical driver assembly 16 includes here a plurality of piezoelectric ceramic segments 18, here PZT (lead-zirconate titanate) ceramic having silver coated electrical conductors 20 disposed on flat surfaces of the ceramic segments 18. In this configuration, polarizing fields are applied between the flat surfaces and the polarity of the ceramic segments 18 are alternated at every other conductor 20. When polarized in this manner, each of the piezoelectric ceramic elements expands and contracts in the direction transverse to the conductors 20 and a net circumferential displacement of the driver is provided.

Each of the ceramic segments 18, here include a notch 22 disposed between the ceramic element and the conductor. Each notch has a sufficient depth for holding a wire (not shown) for providing voltage signals from a transformer assembly to the individual ceramic element 18. The electrical wire is generally attached to the ceramic element using conventional soldering techniques. An alternate approach for supplying voltage signals to the ceramic elements 18 may include providing thin electrical conductor sheets, such as beryllium copper foil, between the ceramic segments. The ceramic elements are then laminated together using a conductive epoxy. The conductor sheets generally include tabbed portions which extend out of the ceramic segments for allowing the attachment of wires to carry voltage signals.

The split-ring transducer assembly 10 comprises a bonded insulator 23 further including an electrically insulative layer 24 disposed between the electromechanical driver assembly 16 and the hollow aluminum tube 12. The insulative layer 24 is desired to have a sufficiently high dielectric strength for preventing arcing between the conductive tube 12 and the ceramic segments 18 of the driver assembly 16. Relatively high voltages (3000–5000 V) are generally required for driving barrel-stave type electromechanical drivers. The insulative layer 24 is further required to be sufficiently thin, so that the layer itself does not have a compliance which absorbs energy from the driver desired to be transferred to the shell. The electrically insulative layer 24 is here, a polyimide film manufactured by Dupont, Wilmington, Del., and sold under the trademark Kapton®. The Kapton® film, here Type F, was selected to have a thickness of 0.002". Type F Kapton® film has a dielectric strength of 7000 V/mil and a dielectric constant of 3.0.

The transducer assembly 10 further includes adhesive layers 26 for bonding the Kapton® polyimide film between the electromechanical driver assembly 16 and the hollow tube 12. The adhesive layers are accordingly desired to have a sufficiently high shear strength for preventing the breaking of the adhesive seal between driver and tube when the transducer is being operated.

In the configuration of the present invention, it is desired that the shear strength be high for bonds between the metal surface of the shell and the polyimide film and between the ceramic surface of the driver and the polyimide film. As was the case with the insulative layer 24, it is also desired that the adhesive layers 26 also be relatively thin for the same reason given in conjunction with the insulative layer and further for reducing the possibility of trapping air bubbles within the adhesive layer during its curing process. Air bubbles generally reduce the dielectric strength of the epoxy. Further still, as is known by those of ordinary skill in the art, the bond shear strength of the layer is inversely related to its thickness. Accordingly, providing an adhesive layer having a relatively large thickness would increase the possibility of breaking the adhesive bond between the tube 12 and driver assembly 16. It is also desired that if the adhesive layer requires a curing process that the cure temperature not exceed a temperature damaging to the other elements of the transducer. The adhesive layers 26 used here for bonding the Kapton® polyimide film between the driver segments 18 and the tube 12 is an epoxy adhesive manufactured by Magnolia Plastics, Inc., Chamblee, Ga., Product No. 93-215. This particular epoxy has a dielectric strength of 400 V/mil and a bond shear strength greater than 2000 psi for a thickness of approximately 0.004" in the cured condition. The cure temperature of the 93-215 epoxy adhesive is less than 180° F. Because the polyimide insulative layer 24 has a relatively smooth and glossy surface, roughening of the surface is generally desired. Techniques such as sandblasting or steel wool abrading may be used to provide an increased surface area for the adhesive layers to bond to.

It is generally desired to provide binding fiber layers 28 within the adhesive layers 26 before the adhesive is allowed to dry or cure for retaining the adhesive layer and for improving the uniformity of the thickness of the adhesive layers 26. Further, the binding fiber layers 28 mitigate the occurrence of the formation of air bubbles in the adhesive layers 26. The binding fiber here is a sheet of randomly oriented fiberglass fibers manufactured by Pellon Corporation, Chelmsford, Mass., Product No. T-T1788 CGL2. An adhesive layer 26 in combination with the binding fiber layer 28 having a thickness of 0.005" has a thickness generally less than 0.007".

An alternate application of the bonding and insulating structure for a split-ring cylindrical transducer is discussed in co-pending application Ser. No. 749,649, filed on Aug. 8, 1991, by G. A. Brigham and P. F. Flanagan, entitled "Electro-Acoustic Transducers" and assigned to the assignee of the present invention.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A transducer comprising:

a transducer shell having an inner surface;

a piezoelectric ceramic electromechanical driver disposed adjacent to the inner surface of the shell;

a first layer, disposed over the inner surface of the shell, comprised of a first adhesive material having a first dielectric strength characteristic and having a first fiber layer disposed through said first adhesive material;

a second layer, disposed over the first layer, comprised of a second adhesive material having a second dielectric strength characteristic and having a second fiber layer disposed through said second adhesive material; and an insulative layer disposed between the first and second layers, said insulative layer having a third dielectric strength characteristic greater than said first and second dielectric strength characteristics.

2. The transducer as recited in claim 1 wherein the first and second adhesive materials are an epoxy.

3. The transducer as recited in claim 2 wherein the insulative means has a dielectric strength greater than 2000 V/mil.

4. The transducer of claim 2 wherein the insulative material is a polyimide film.

5. The transducer as recited in claim 4 wherein the first and second adhesive materials have bond shear strength characteristics greater than 200 psi.

6. The transducer as recited in claim 5 wherein the first layer, second layer, and polyimide film, in combination has a thickness less than 0.010".

7. The transducer as recited in claim 6 wherein each of said fiber layers is comprised of fiberglass.

8. The transducer of claim 6 wherein said fiberglass layers are comprised of randomly oriented fiberglass fibers.

9. A transducer comprising:

a hollow metal tube having an inner surface;

an electromechanical driver disposed adjacent to the inner surface of the metal tube;

a first layer, disposed over the inner surface of the shell, comprised of an epoxy having a first dielectric strength characteristic and having a fiberglass layer disposed through said epoxy;

a second layer, disposed over the first layer, comprised of an epoxy having a second dielectric strength characteristic and having a fiberglass layer disposed through said epoxy; and a polyimide film disposed between the first and second layers, said polyimide film having a third dielectric strength characteristic greater than said first and second dielectric strength characteristics.

10. The cylindrical transducer as recited in claim 9 wherein the electromechanical driver is a piezoelectric ceramic driver.

11. The transducer as recited in claim 10 wherein the insulative means has a dielectric strength greater than 2000 V/mil.

12. The transducer as recited in claim 11 wherein the epoxy has a bond shear strength characteristics greater than 2000 psi.

13. The transducer as recited in claim 12 wherein the first layer, second layer, and polyimide film, in combination has a thickness less than 0.010".

14. The transducer as recited in claim 13 wherein the fiberglass layers are comprised of randomly oriented fiberglass fibers.

* * * * *